US006202902B1

(12) United States Patent
Starr

(10) Patent No.: US 6,202,902 B1
(45) Date of Patent: Mar. 20, 2001

(54) POWDER-CONTAINING SIFTER BOTTLE

(76) Inventor: Robert Starr, 71 Centennial Road, Orangeville (CA)

( * ) Notice: Subject to any disclaimer, the term of this patent is extended or adjusted under 35 U.S.C. 154(b) by 0 days.

(21) Appl. No.: 09/439,958

(22) Filed: Nov. 12, 1999

(51) Int. Cl.[7] ..... B65D 3/00
(52) U.S. Cl. ..... 222/548
(58) Field of Search ..... 222/548, 142.9, 222/480

(56) References Cited

U.S. PATENT DOCUMENTS 2,049,795 * 8/1936 Barnby ..... 222/548
3,260,426 * 7/1966 Ayotte ..... 222/548
5,383,582 * 1/1995 Baxter et al. ..... 222/548

* cited by examiner

*Primary Examiner*—Philippe Derakshani

(74) *Attorney, Agent, or Firm*—Herbert Dubno; Andrew Wilford

(57) ABSTRACT

A package has a bottle formed with an annular open and rigid neck centered on an axis, a mass of finely divided powder in the bottle, an inner part engaged over the open neck and formed with an array of throughgoing holes, an outer part engaged over the inner part, formed with a similar array of throughgoing holes, and rotatable about the axis between an open position with its holes aligned with the holes of the inner part and a closed position with its holes out of alignment with the holes of the inner part. A flexible annular lip formed unitarily with the neck projects axially outward therefrom and elastically engages the inner part around the array of holes thereof. The inner part has a radially inwardly directed surface and the neck has an outer surface formed offset from the lip with a radially outwardly directed surface confronting the surface of the inner part. One of the surfaces is formed with an axially extending and radially open groove and the other of the surfaces is formed with a generally complementary, axially extending and radially projecting ridge engaged in the groove so that the ridge and groove lock the inner part on the neck against rotation thereon.

8 Claims, 1 Drawing Sheet

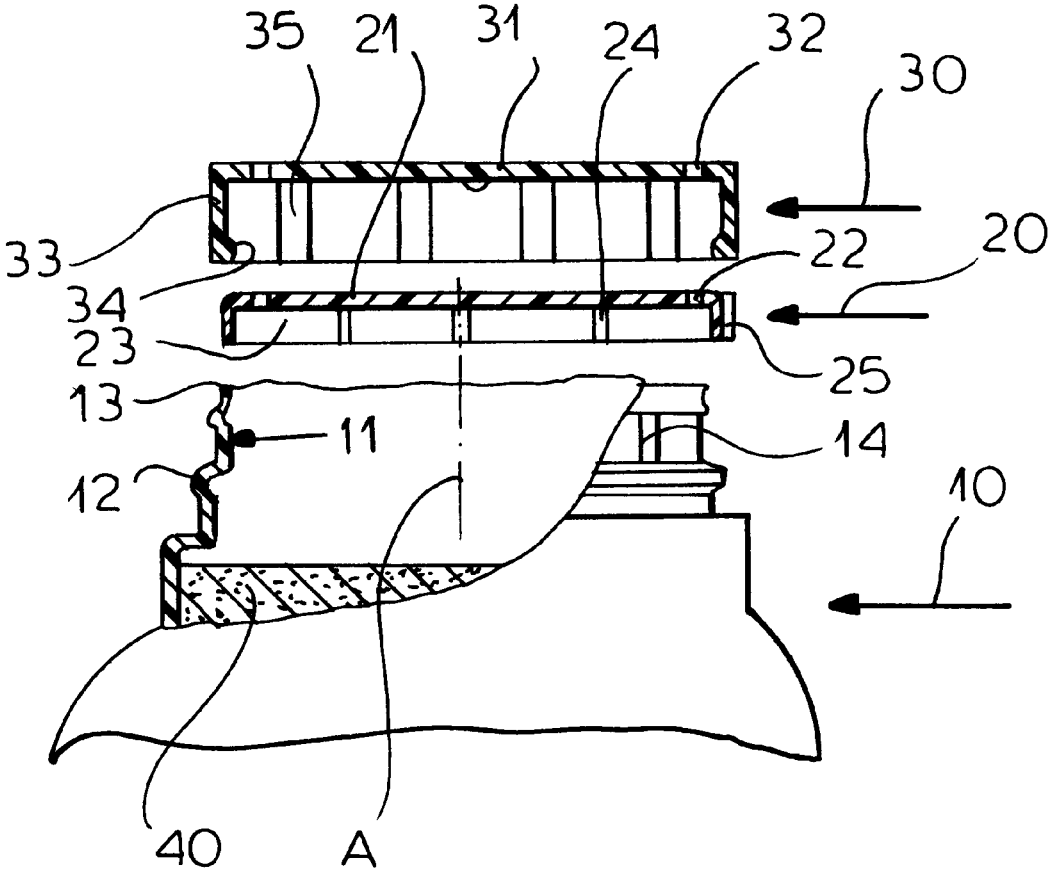
35
21
31
24
32
30
33
22
20
34
23
25
13
11
14
12
10
40
A

POWDER-CONTAINING SIFTER BOTTLE

FIELD OF THE INVENTION

The present invention relates to a container for power. More particularly this invention concerns a powder-containing sifter bottle.

BACKGROUND OF THE INVENTION

A standard sifter bottle intended to hold a supply of fine powder, for instance talcum powder, has a neck or finish to which is fitted a sifter cap. The cap comprises an inner disk part that snaps tightly to the bottle neck and normally does not move once installed, and an outer cup-shaped part engaged with a collar down around the disk with a rim on the bottle neck. The two parts are formed with identical arrays of holes and the outer part can be twisted between an open position with its holes aligned with those of the inner part and a closed position with the arrays of holes offset from each other. In the aligned position powder can be shaken out of the bottle through the cap.

Normally the bottle neck or finish is of cylindrical shape and is formed with a radially outwardly projecting annular ridge that engages under a radially inwardly projecting rim of the outer part. The inner part and neck are also formed with, relative to an axis on which the neck is centered, axially extending groove and ridge formations that interengage to rotationally lock the inner part on the neck so that it does not rotate with the outer part.

The main problem with this type of package is leakage around the edge of the cap. On the one hand the outer part must be mounted loosely enough that it can be turned easily and that it can easily be snapped in place over the neck after filling, and on the other hand it must be tight enough that the powder cannot readily leak out of the joint between the outer part and the neck. One must therefore trade off ease of use and manufacture with potential for leakage so that the bottles and caps must be made to very tight tolerances. As a result they are expensive to manufacture, since if the fit is too tight the cap will not turn and/or the bottle will be crushed as the cap is fitted to it after filling, and when the cap is too loose the resultant package is messy and unmarketable.

OBJECTS OF THE INVENTION

It is therefore an object of the present invention to provide an improved powder-containing bottle with a sifter cap.

Another object is the provision of such an improved powder-containing bottle with a sifter cap which overcomes the above-given disadvantages, that is which is easy to open and close, which easy to manufacture, and which will not leak.

SUMMARY OF THE INVENTION

A package has according to the invention a bottle formed with an annular open and rigid neck centered on an axis, a mass of finely divided powder in the bottle, an inner part engaged over the open neck and formed with an array of throughgoing holes, an outer part engaged over the inner part, formed with a similar array of throughgoing holes, and rotatable about the axis between an open position with its holes aligned with the holes of the inner part and a closed position with its holes out of alignment with the holes of the inner part. In accordance with the invention a flexible annular lip formed unitarily with the neck projects axially outward therefrom and elastically engages the inner part around the array of holes thereof.

Thus with this system the fit of the outer part, inner part, and neck is not extremely critical since the flexible lip can compensate, producing a powder-tight fit between the neck and the inner part. As a result the neck and cap parts can be made to looser tolerances, facilitating manufacture and assembly of the package.

According to the invention the inner part has a radially inwardly directed surface and the neck has an outer surface formed offset from the lip with a radially outwardly directed surface confronting the surface of the inner part. One of the surfaces is formed with an axially extending and radially open groove and the other of the surfaces is formed with a generally complementary, axially extending and radially projecting ridge engaged in the groove so that the ridge and groove lock the inner part on the neck against rotation thereon.

The outer part in accordance with the invention has an annular rim projecting axially toward the bottle past the lip and past the inner part and the rim and neck are formed with annular ridges riding on each other and retaining the outer part on the neck. Thus the outer part is a snap fit over the ridge of the neck. In addition the inner part has a radially outwardly directed surface and the rim has a radially inwardly directed surface radially confronting the inner-part surface and one of the surfaces is formed with a wide axially extending groove and the other of the surfaces is formed with a narrow axially extending ridge engaged in the groove with angular play. The outer part is therefore angularly displaceable on the inner part with the ridge moving angularly from one end to an opposite and of the groove. In fact the inner part can be made of uniform wall thickness with inner grooves mating with outer ridges on the neck to fix it against rotation on the neck and outer ridges fitting in wider inner grooves in the outer cap part.

The neck and lip are unitarily made of plastic and the lip has a radially outwardly concave C-section. Furthermore this lip has a radial thickness equal to at most one third a radial thickness of the neck and an axial length equal to at least twice its radial thickness.

BRIEF DESCRIPTION OF THE DRAWINGS

The above and other objects, features, and advantages will become more readily apparent from the following description, reference being made to the accompanying drawing whose sole FIGURE is a side view mainly in axial section through a powder-filled package according to the invention.

SPECIFIC DESCRIPTION

As seen in the drawing a package according to the invention is basically comprised of a bottle 10, a disk-like inner part 20, and a cup-shaped outer part 30, all made by injection molding of a durable plastic such as high-density polyethylene. The bottle 10 contains a mass 40 of finely divided powder, for instance talc.

The bottle 10 is formed centered on an axis A with an annular neck 11 itself forming a radially outwardly projecting ridge 12. At its outer and the neck 11 is formed with a C-shaped outwardly concave lip 13 that is sufficiently thin, having a thickness equal to at most one-third of the thickness of the neck 11, that it is quite elastically deformable. In addition the neck 11 is formed below the lip 13 with three axially extending, angularly equispaced, and radially outwardly projecting ridges 14.

The inner part 20 is formed basically as a flat disk 21 formed with an annular array of nine angularly equispaced throughgoing holes 22. It has an axially projecting cylindrical rim 23 formed with nine radially inwardly open, axially extending, and angularly equispaced grooves 24 and in radial alignment therewith with none radially outwardly projecting, axially extending and angularly equispaced ridges 25. The grooves 23 are of the same angular dimension as the ridges 14 of the neck 11 so that when the part 20 is fitted to the neck 11 these ridges 14 fit snugly in the grooves 23 and lock the part 20 to the neck 11 against angular displacement thereon.

The outer part 30 is formed as a flat disk 31 in turn formed with an annular array of nine angularly equispaced throughgoing holes 32 arrayed identically to the holes 22. This part 30 has an axially projecting cylindrical rim 33 formed on its inner surface with a radially inwardly projecting ridge or bump 34 that engages in the assembled package under the ridge 12, securing the part 30 axially to the bottle 10. In addition the rim 33 is formed with nine axially extending, radially inwardly projecting, and angularly equispaced ridges 35 that engage with considerable angular play in grooves formed between the ridges 25. Thus the outer part 30 can move angularly on the inner part 20 between an open position with its holes 32 aligned with the holes 22 and a closed position with the holes 22 and 32 out of alignment.

The spacing between the ridge 34 and the disk 31 of the outer part 30 and between the ridge 12 and the outer end of the lip 13 and the thickness of the disk part 21 of the inner part 20 are such that when the inner part 20 is sitting on the lip 13 and the ridge 34 is snapped under the lip 12, the lip 13 is compressed somewhat. This causes the lip 13 to form a powder-tight seal with the underside of the disk part 21 of the inner part 20 around its holes 22, thereby preventing any of the powder 40 from exiting at this joint.

I claim:

1. A package comprising:

a bottle formed with an annular open and rigid neck centered on an axis;

a mass of finely divided powder in the bottle;

an inner part engaged over the open neck and formed with an array of throughgoing holes;

an outer part engaged over the inner part, formed with a similar array of throughgoing holes, and rotatable about the axis between an open position with its holes aligned with the holes of the inner part and a closed position with its holes out of alignment with the holes of the inner part; and a flexible annular lip formed unitarily with the neck, projecting axially outward therefrom, and elastically engaging the inner part around the array of holes thereof.

2. The package defined in claim 1 wherein the inner part has a radially inwardly directed surface and the neck has an outer surface formed off set from the lip with a radially outwardly directed surface confronting the surface of the inner part, one of the surfaces being formed with an axially extending and radially open groove and the other of the surfaces being formed with a generally complementary, axially extending and radially projecting ridge engaged in the groove, whereby the ridge and groove lock the inner part on the neck against rotation thereon.

3. The package defined in claim 2 wherein the outer part has an annular rim projecting axially toward the bottle past the lip and past the inner part and the rim and neck are formed with annular ridges riding on each other and retaining the outer part on the neck.

4. The package defined in claim 1 wherein the inner part has a radially outwardly directed surface and the rim has a radially inwardly directed surface radially confronting the inner-part surface, one of the surfaces being formed with a wide axially extending groove and the other of the surfaces being formed with a narrow axially extending ridge engaged in the groove with angular play, the outer part being angularly displaceable on the inner part with the ridge moving angularly from one end to an opposite end of the groove.

5. The package defined in claim 1 wherein the neck and lip are unitarily made of plastic.

6. The package defined in claim 5 wherein the lip has a radially outwardly concave C-section.

7. The package defined in claim 1 wherein the lip has a radial thickness equal to at most one third a radial thickness of the neck.

8. The package defined in claim 7 wherein the lip has an axial length equal to at least twice its radial thickness.

* * * * *